US006368227B1

(12) United States Patent
Olson

(10) Patent No.: US 6,368,227 B1
(45) Date of Patent: Apr. 9, 2002

(54) METHOD OF SWINGING ON A SWING

(76) Inventor: Steven Olson, 337 Otis Ave., St. Paul, MN (US) 55104

( * ) Notice: Subject to any disclaimer, the term of this patent is extended or adjusted under 35 U.S.C. 154(b) by 0 days.

(21) Appl. No.: 09/715,198

(22) Filed: Nov. 17, 2000

(51) Int. Cl.[7] ..... A63G 9/00
(52) U.S. Cl. ..... 472/118
(58) Field of Search ..... 472/118, 119, 472/120, 121, 122, 123, 125

(56) References Cited

U.S. PATENT DOCUMENTS 242,601 A * 6/1881 Clement ..... 472/118

5,413,298 A * 5/1995 Perreault ..... 248/228

* cited by examiner

*Primary Examiner*—Kien T. Nguyen
(74) *Attorney, Agent, or Firm*—Peter Lowell Olson

(57) ABSTRACT

A method of swing on a swing is disclosed, in which a user positioned on a standard swing suspended by two chains from a substantially horizontal tree branch induces side to side motion by pulling alternately on one chain and then the other.

4 Claims, 3 Drawing Sheets

METHOD OF SWINGING ON A SWING

TECHNICAL FIELD

The present invention relates to a method of swinging on a swing.

BACKGROUND OF THE INVENTION

A few basic types of swings have been around for generations. Perhaps the most common is one that includes a seat suspended between two ropes or chains that are hung from a tree branch or other substantially horizontal support. These swings are often found in side-by-side sets of two or three or more on, for example, a school playground.

Young children often need help to climb onto a swing, and may need a push (sometimes even an "underdog" push) to begin swinging. Others may be able to begin the swinging movement on their own by pushing with their feet against the ground, and once moving may coordinate the motion of their legs and body in what may be called "pumping" to sustain the movement of the swing. When swinging in this manner, the user travels along a path as generally shown in the cross-section of FIG. 1. Another method of swinging on a swing involves twisting the seat around repeatedly so that the chains or ropes are wound in a double helix. When allowed to unwind, the swing spins quickly, which can be entertaining for the user.

These methods of swinging on a swing, although of considerable interest to some people, can lose their appeal with age and experience. A new method of swinging on a swing would therefore represent an advance of great significance and value.

SUMMARY OF THE INVENTION

In accordance with one embodiment of the present invention, a method is provided for swinging on a swing. The swing comprises a seat for supporting a user that is suspended between two chains that are hung from a substantially horizontal tree branch. The method comprises the steps of: a) positioning a user on the seat; and b) having the user pull alternately on one chain to induce movement of the user and the swing toward one side, and then on the other chain to induce movement of the user and the swing toward the other side, to create side-to-side motion. In another embodiment of the invention, the swinging method may be practiced independently by the user to create the side-to-side motion from an initial dead stop. These and other features of the invention are described in greater detail below.

DETAILED DESCRIPTION OF THE INVENTION

The present inventor has created, through experimentation on a standard swing, a new and improved method of swinging. The swing is of the type described above, in which a seat is suspended between two chains that are hung from a substantially horizontal tree branch. As is apparent to those of ordinary skill in the area of swinging, the chains could be replaced with ropes, cables, or the like, or the tree branch could be replaced with another substantially horizontal support such as a metal bar or pole.

The standard swing should be a single swing that is suspended sufficiently far away from obstructions to make the practice of the inventive swinging method completely safe. That is, the swing should be suspended a sufficient distance away from the trunk of the tree from which it suspended, and from any other swing, building, support, overhead wire, or other obstruction or threat to safety that may be present.

Figure 1:
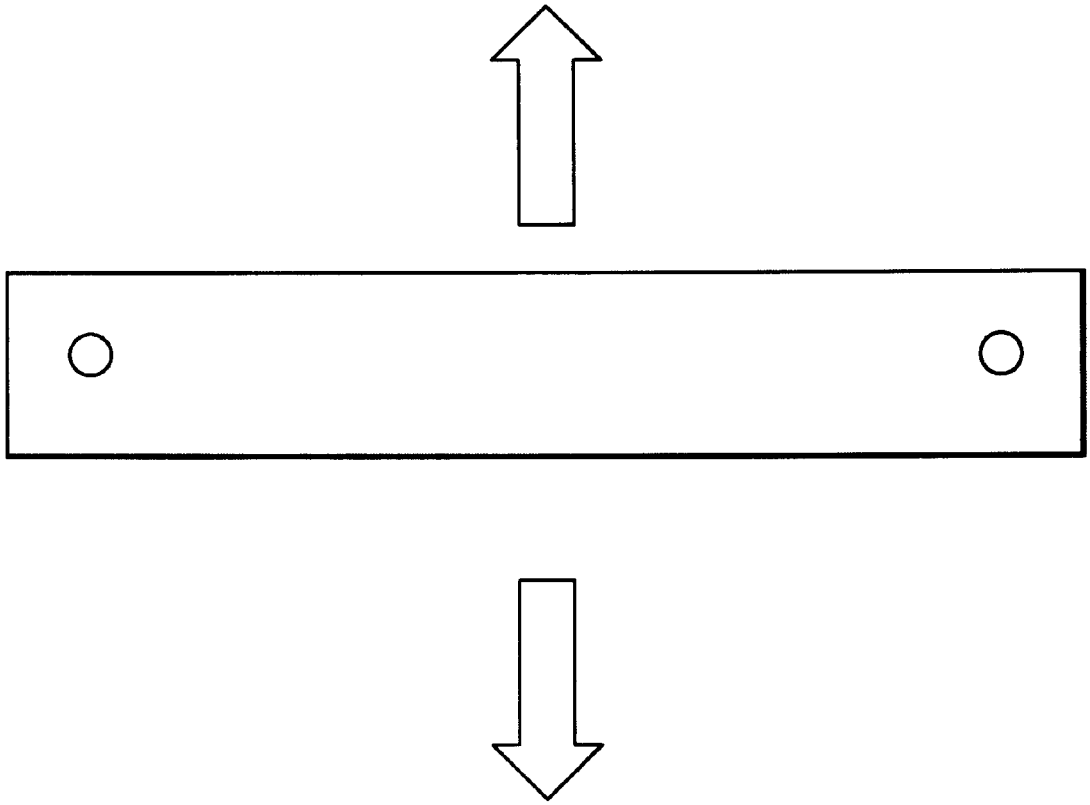
FIG. 1 is a schematic top view of the swinging path of a swing used in accordance with conventional swinging methods.
Figure 2:
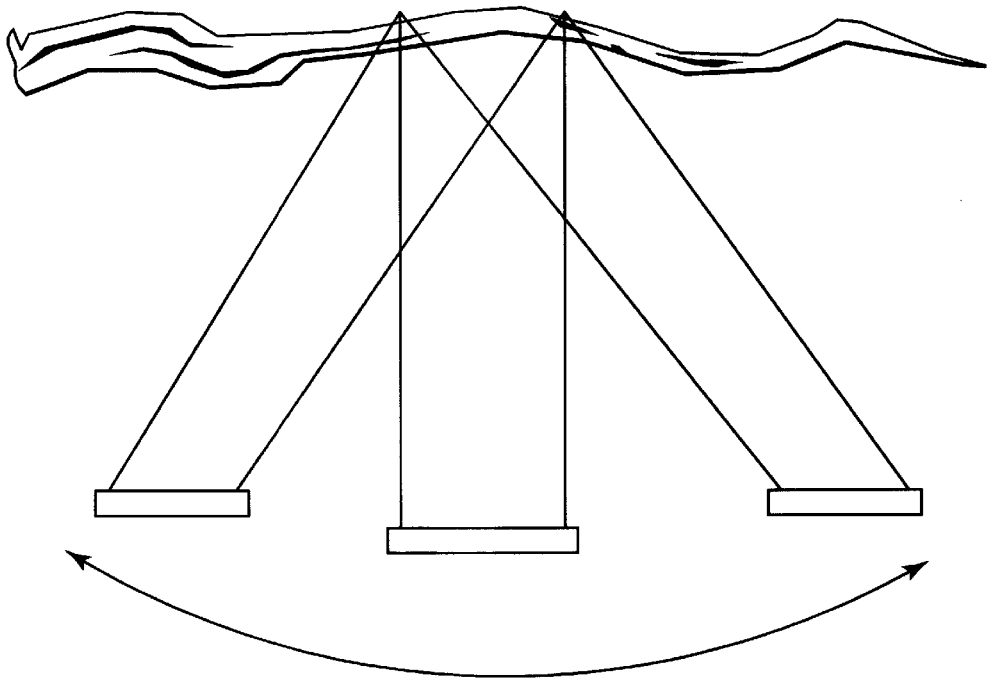
FIG. 2 is a front view of a swinging path of a swing used in accordance with one embodiment of the swinging method of the present invention.

The standard method of swinging on a swing is defined by oscillatory motion of the swing and the user along an axis that is substantially perpendicular to the axis of the tree branch from which the swing is suspended. This "forward and back" movement has been known for generations, and is illustrated in FIG. 1. In contrast to the conventional method of swinging, the present inventor has discovered that much greater satisfaction can be obtained by alternately pulling on one chain to move the swing and the user toward that side, and then pulling on the other chain to move the swing and the user toward that side. This side-to-side oscillatory motion of the swing and the user is thus along an axis that is substantially parallel to the axis of the tree branch from which the swing is suspended, and is illustrated in FIG. 2. This side to side swinging method has the added benefit that it can be continued for long periods of time simply by alternately pulling on one chain and then the other. The importance of sufficient clearance between the swing and any obstructions or threats to the user's safety is apparent.

The present inventor has discovered certain other improvements in the art of swinging on a swing, either or both of which can be used in conjunction with the swinging method described immediately above. The first is that the inventive swinging method can be initiated from a dead stop without pushing, and without the user having to contact the ground. That is, the user can climb onto the swing, and begin from an initial dead stop to pull first on one chain, and then on the other chain, alternately until the user and the swing have begun to swing side-to-side in accordance with the inventive swinging method described herein. This enables even young users to swing independently and joyously, which is of great benefit to all.

Figure 3:
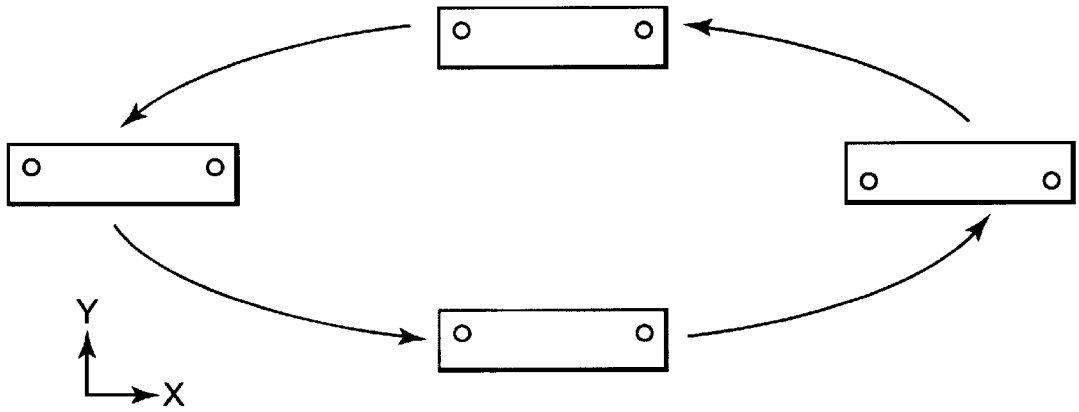
FIG. 3 is a schematic top view of a swinging path of a swing used in accordance with a second embodiment of the swinging method of the present invention.

Another improvement on the swinging method described above is the induction into the side-to-side swinging movement of a component of forward-and-back motion. That is, by skillful manipulation of the body, the present inventor has found it possible to add a relatively minor component of forward-and-back motion to the side-to-side swinging motion, resulting in a swinging path that is generally shaped like an oval, as is shown in FIG. 3. It is preferred that the magnitude of the forward-and back motion (shown in FIG. 3 as being along the Y axis) be less than the magnitude of the side-to side motion (shown in FIG. 3 as being along the X axis), so that the latter predominates. In this manner, the motion can be more easily continued simply by alternately pulling on one chain and then the other in the manner described.

Lastly, it should be noted that because pulling alternately on one chain and then the other resembles in some measure the movements one would use to swing from vines in a dense jungle forest, the swinging method of the present invention may be referred to by the present inventor and his sister as "Tarzan" swinging. The user may even choose to produce a Tarzan-type yell while swinging in the manner described, which more accurately replicates swinging on vines in a dense jungle forest. Actual jungle forestry is not required.

Licenses are available from the inventor upon request.

I claim:

1. A method of swinging on a swing, the method comprising the steps of:

a) suspending a seat for supporting a user between only two chains that are hung from a tree branch;

b) positioning a user on the seat so that the user is facing a direction perpendicular to the tree branch;

c) having the user pull alternately on one chain to induce movement of the user and the swing toward one side, and then on the other chain to induce movement of the user and the swing toward the other side; and d) repeating step c) to create side-to-side swinging motion, relative to the user, that is parallel to the tree branch.

2. The method of claim 1, wherein the method is practiced independently by the user to create the side-to-side motion from an initial dead stop.

3. The method of claim 1, wherein the method further comprises the step of:

e) inducing a component of forward and back motion into the swinging motion, resulting in a swinging path that is generally shaped as an oval.

4. The method of claim 3, wherein the magnitude of the component of forward and back motion is less than the component of side-to-side motion.

* * * * *

US006368227C1

(12) REEXAMINATION CERTIFICATE (4803rd)

United States Patent

Olson

(10) Number: US 6,368,227 C1

(45) Certificate Issued: Jul. 1, 2003

(54) METHOD OF SWINGING ON A SWING

(75) Inventor: Steven Olson, 337 Otis Ave., St. Paul, MN (US) 55104

(73) Assignee: Steven Olson, St. Paul, MN (US)

Reexamination Request:
No. 90/006,289, May 21, 2002

Reexamination Certificate for:

| | |
|---|---|
| Patent No.: | **6,368,227** |
| Issued: | **Apr. 9, 2002** |
| Appl. No.: | **09/715,198** |
| Filed: | **Nov. 17, 2000** |

(51) Int. Cl.[7] ..... A63G 9/00

(52) U.S. Cl. ..... 472/118

(58) Field of Search ..... 272/85, 86, 87, 272/88, 91, 89, 90; 472/121, 125; 403/62

(56) References Cited

U.S. PATENT DOCUMENTS

| | | | | |
|---|---|---|---|---|
| 2,146,045 | A | * | 2/1939 | Zippler |
| 2,325,456 | A | * | 7/1943 | Williams |
| 3,447,802 | A | * | 6/1969 | Grudoski |

* cited by examiner

*Primary Examiner*—Derris H. Banks

(57) ABSTRACT

A method of swing on a swing is disclosed, in which a user positioned on a standard swing suspended by two chains from a substantially horizontal tree branch induces side to side motion by pulling alternately on one chain and then the other.

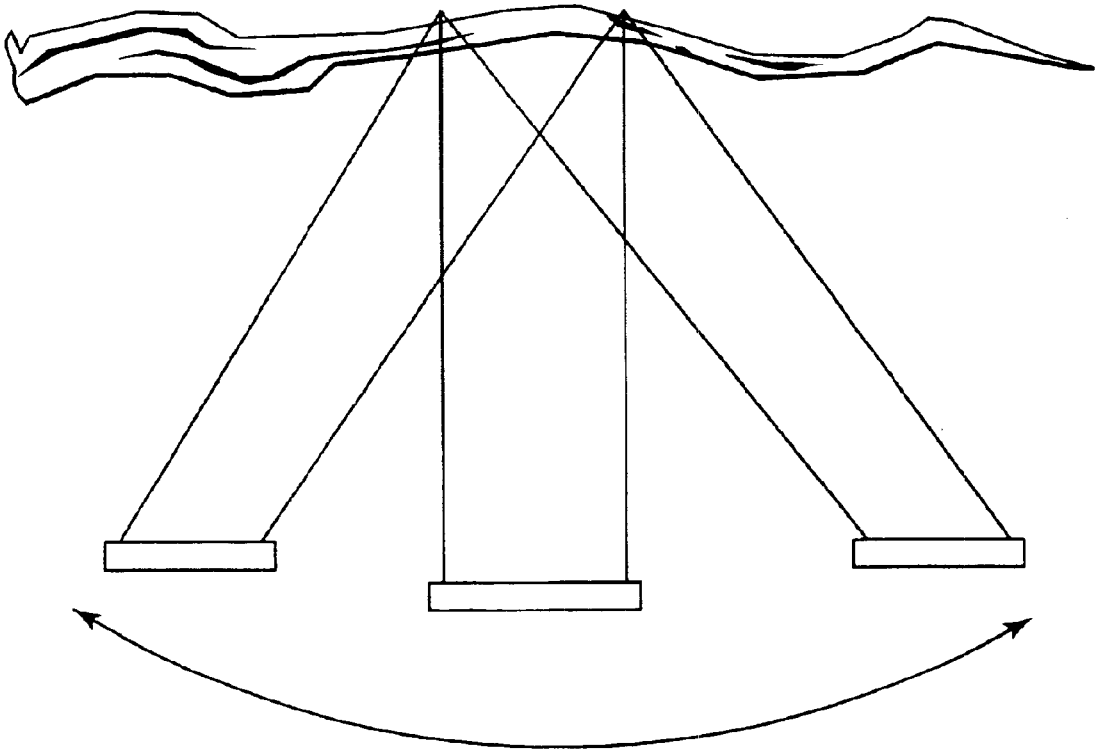

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1, 2, 3 and 4 are cancelled.

* * * * *